US008154467B2

(12) United States Patent
Mitsui

(10) Patent No.: US 8,154,467 B2
(45) Date of Patent: Apr. 10, 2012

(54) ANTENNA APPARATUS AND WIRELESS COMMUNICATION TERMINAL

(75) Inventor: Tsutomu Mitsui, Yokohama (JP)

(73) Assignee: Samsung Electronics Co., Ltd (KR)

( * ) Notice: Subject to any disclaimer, the term of this patent is extended or adjusted under 35 U.S.C. 154(b) by 513 days.

(21) Appl. No.: 12/142,244

(22) Filed: Jun. 19, 2008

(65) Prior Publication Data

US 2008/0316098 A1 Dec. 25, 2008

(30) Foreign Application Priority Data

Jun. 21, 2007 (JP) ..... 2007-163366

(51) Int. Cl.
*H01Q 19/00* (2006.01)

(52) U.S. Cl. ..... 343/833; 343/817; 343/853; 343/757

(58) Field of Classification Search ..... 343/700 MS, 343/817, 818, 841, 844, 853, 702, 757, 833, 343/834
See application file for complete search history.

(56) References Cited

U.S. PATENT DOCUMENTS

| | | | | |
|---|---|---|---|---|
| 5,220,335 | A * | 6/1993 | Huang | 343/700 MS |
| 6,025,812 | A * | 2/2000 | Gabriel et al. | 343/797 |
| 6,049,310 | A * | 4/2000 | Sadahiro | 343/702 |
| 6,407,705 | B1 * | 6/2002 | Sanad | 343/700 MS |
| 6,473,040 | B1 | 10/2002 | Nakamura | |
| 6,642,893 | B1 * | 11/2003 | Hebron et al. | 343/702 |
| 7,027,000 | B2 * | 4/2006 | Takagi et al. | 343/702 |
| 7,352,328 | B2 * | 4/2008 | Moon et al. | 343/700 MS |
| 7,696,943 | B2 * | 4/2010 | Chiang | 343/833 |
| 7,728,785 | B2 * | 6/2010 | Ozden | 343/866 |
| 2004/0032370 | A1 | 2/2004 | Ito et al. | |
| 2004/0164919 | A1 * | 8/2004 | Nilsson | 343/833 |
| 2005/0162327 | A1 | 7/2005 | Mori | |
| 2006/0279465 | A1 | 12/2006 | Moon et al. | |
| 2007/0069960 | A1 | 3/2007 | Moon et al. | |
| 2010/0328163 | A1 * | 12/2010 | Abramov et al. | 343/702 |

FOREIGN PATENT DOCUMENTS

WO WO 01/48862 7/2001

* cited by examiner

*Primary Examiner* — Douglas W Owens
*Assistant Examiner* — Chuc D Tran
(74) *Attorney, Agent, or Firm* — Samsung Electronics Co., Ltd

(57) ABSTRACT

Disclosed is an antenna apparatus which can control directivity of a plurality of radiation elements using one parasitic element. The antenna apparatus includes two radiation elements arranged on a base parallel to each other, and a parasitic element disposed between the two radiation elements. Radiation directivity of the two radiation elements is controlled according to the length of the parasitic element. This configuration provides a small-sized antenna apparatus including a plurality of radiators with desired directivity.

11 Claims, 7 Drawing Sheets

ANTENNA APPARATUS AND WIRELESS COMMUNICATION TERMINAL

PRIORITY

This application claims priority under 35 U.S.C. §119(a) to application entitled "Antenna Apparatus and Wireless Communication Terminal" filed with the Japanese Intellectual Property Office on Jun. 21, 2007 and assigned Serial No. 2007-163366, the contents of which are incorporated herein by reference.

BACKGROUND OF THE INVENTION

1. Field of the Invention

The present invention relates generally to an antenna apparatus and wireless communication terminal, and more particularly, to an antenna apparatus that can control directivity of a plurality of radiation elements using a parasitic element.

2. Description of the Related Art

Recently, communication technologies for realizing high-speed communication in portable terminals, such as hand-held phones, PDAs, etc., have been in the spotlight. Some of them (for example, Multiple Input Multiple Output (MIMO)) have been put to practical use, in which both a transmitting device and a receiving device have a plurality of antennas and transmit/receive signals through the antennas, respectively. Such technologies enable very high-speed communication because information corresponding to the number of a plurality of antennas can be received, though there is overhead in a signal separation process, etc. However, in the application of a MIMO system, it is necessary to mount a plurality of antennas with suitable directivity to a small-sized box body of the portable terminal. For this reason, it has been required to manufacture small-sized antennas with desired directivity. More specifically, a device capable of simply controlling directivity of a plurality of antennas has been required.

As the control technique of the antenna directivity, a manner where driven elements are disposed in the front side and rear side of a radiation element is well-known in the art. A typical example of this is a Yagi-Uda antenna. The Yagi-Uda antenna has already been put to practical use and is now in wide use as a receiving antenna for an analog TV. As an application of the Yagi-Uda antenna, Japanese Patent No. 2005-210521 discloses a planar plate antenna that includes a slot yagi antenna and driven elements disposed round about the slot yagi antenna, wherein electric fields are converted to control directivity. As for a resonant frequency, the driven elements of this antenna can be configured to function as reflectors by forming them to be relatively long and as directors by forming them to be relatively short. Therefore, this antenna can convert the directivity according to the lengths of the driven elements.

However, in order to permit vertically polarized radiation, the antenna described above should be enlarged in size in a horizontal direction due to a structural characteristic thereof. Thus, this antenna is difficult to mount onto portable terminals. Also, the user usually holds the portable terminal slightly tilted in front of him when using it. Therefore, when the antenna is mounted to the portable terminal, directional peaks go toward the user's body or the ground blocking them, so it is difficult for this antenna to obtain sufficient communication quality ensuring high-speed communication in a MIMO system.

In another example, a monopole type antenna is mounted at a front end of a portable terminal. This antenna also does not provide satisfactory communication quality since directional peaks of radio waves radiated from the antenna go toward the ground. Contrarily, it can also be considered that a monopole type antenna is mounted to the portable terminal in the direction of the rear end of the terminal, but directional peaks of radio waves affected by a base board go toward the user's body to block them, whereby the sensitivity of the radio waves is reduced.

SUMMARY OF THE INVENTION

The present invention has been made to address at least the above-mentioned problems and/or disadvantages and to provide at least the advantages described below. Accordingly, an aspect of the present invention provides a novel and improved antenna apparatus and a wireless communication terminal which have relatively simple structure and can control directivity of a plurality of radiation elements.

According to one aspect of the present invention, an antenna apparatus is provided which includes two radiation elements arranged on a base parallel to each other, and a parasitic element disposed between the two radiation elements. Radiation directivity of the two radiation elements is controlled according to the length of the parasitic element.

The parasitic element may, when shorter than the radiation elements, function as a director and tilt directional peaks toward the parasitic element.

The parasitic element may, when longer than the radiation elements, function as a reflector and tilt directional peaks toward the radiation elements.

The parasitic element may be formed of a quarter wavelength ($\lambda/4$) short-circuited patch antenna.

In addition, the radiation elements and the parasitic element may respectively include a planar plate portion nearly parallel to the base, a short-circuited portion extending from one end of the planar plate portion to be short-circuited to the base, and an opening portion formed by an opposite end of the planar plate portion spaced apart from the base. Each of the opening portions of the two radiation elements is opened in a predetermined first direction, and the opening portion of the parasitic element is opened in the opposite direction of the first direction.

Each of the lengths of the parasitic element and the radiation elements is a length extended in the first direction and defined between the short-circuited portion thereof and the opening portion thereof.

The antenna apparatus may, in addition to the two radiation elements and the parasitic element arranged on a first face of the base, further include two additional radiation elements arranged on a second face of the base and parallel to each other, and an additional parasitic element disposed between the two additional radiation elements.

The additional parasitic element may, when shorter than the additional radiation elements, function as a director and tilts directional peaks toward a direction of the parasitic element.

The additional parasitic element may, when longer than the additional radiation elements, function as a reflector and tilts directional peaks toward directions of the additional radiation elements.

The additional radiation elements may be each formed of a quarter wavelength ($\lambda/4$) short-circuited patch antenna.

The additional radiation elements and the additional parasitic element may respectively include a planar plate portion nearly parallel to the base, a short-circuited portion extending from one end of the planar plate portion to be short-circuited to the base, and an opening portion formed by an opposite end of the planar plate portion spaced apart from the base. Each of the opening portions of the two additional radiation elements is opened in a predetermined second direction, and the opening portion of the parasitic element is opened in the opposite direction of the second direction.

Each of the lengths of the additional parasitic element and the additional radiation elements is a length extended in the first direction and defined between the short-circuited portion thereof and the opening portion thereof.

The parasitic element may be formed to be longer than the radiation elements, and the additional parasitic element may be formed to be shorter than the additional radiation elements.

The first direction and the second direction are nearly the same as each other, the lengths of the radiation elements and the lengths of the additional radiation elements are nearly the same as each other, and the length of the parasitic element and the length of the additional parasitic element are nearly the same as each other. The antenna apparatus may further include a feed part adapted to perform feed-controlling of the radiation elements and the additional radiation elements so as to be synchronized to transmit/receive modulated signals of the multiple-input multiple-output modulated system.

In accordance with another aspect of the present invention, a wireless communication terminal is provided including the antenna apparatus. In addition, the wireless communication terminal may include a means of feed-controlling capable of the feed-control.

With the apparatus, since only one parasitic element is needed to control the radiation directivity of the radiation elements, simplifying the size of the antenna apparatus becomes possible. As a result, the antenna apparatus can be more miniaturized, and the directivity of the antenna apparatus that is in need of a plurality of radiation elements for MIMO system can be controlled by relatively simple unit.

BRIEF DESCRIPTION OF THE DRAWINGS

The above and other features, aspects, and advantages of the present invention will be more apparent from the following detailed description when taken in conjunction with the accompanying drawings, in which.

DETAILED DESCRIPTION OF THE PREFERRED EMBODIMENTS

Figure 1A:
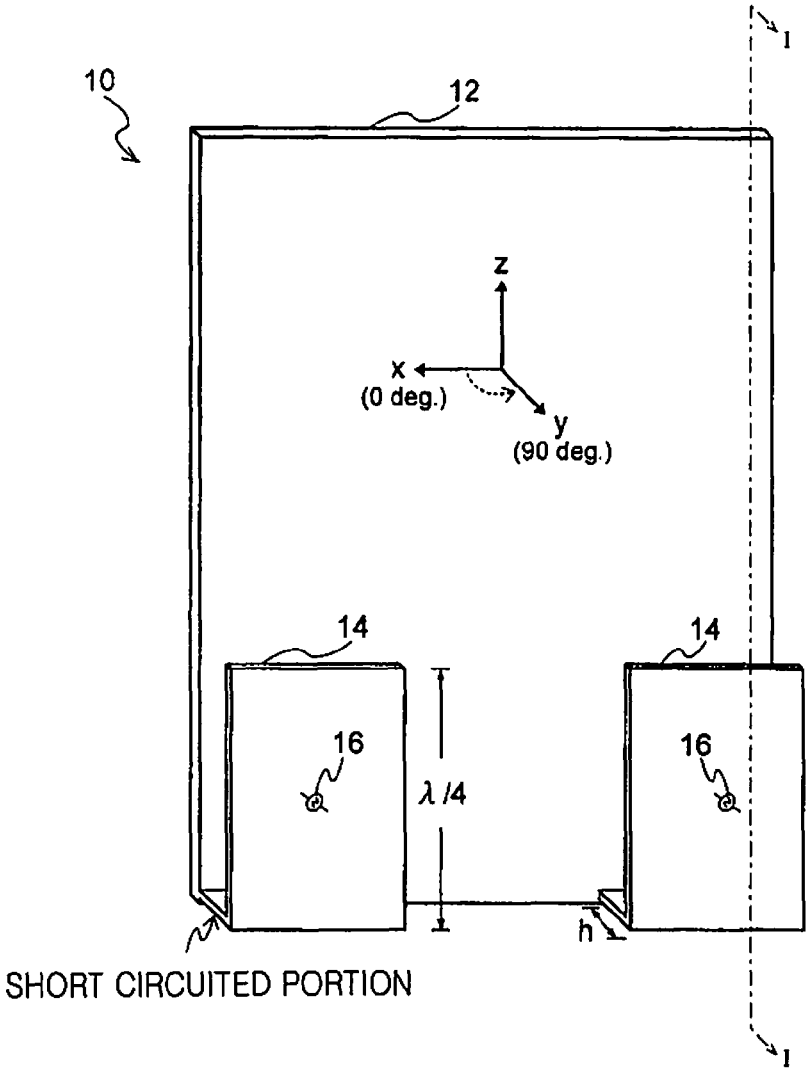
FIGS. 1A and 1B are diagrams illustrating an antenna apparatus having a plurality of patch antennas.

Preferred embodiments of the present invention are described in detail with reference to the accompanying drawings. It should be noted that similar components are designated by similar reference numerals although they are illustrated in different drawings. Detailed descriptions of constructions or processes known in the art may be omitted to avoid obscuring the subject matter of the present invention.

Figure 1B:
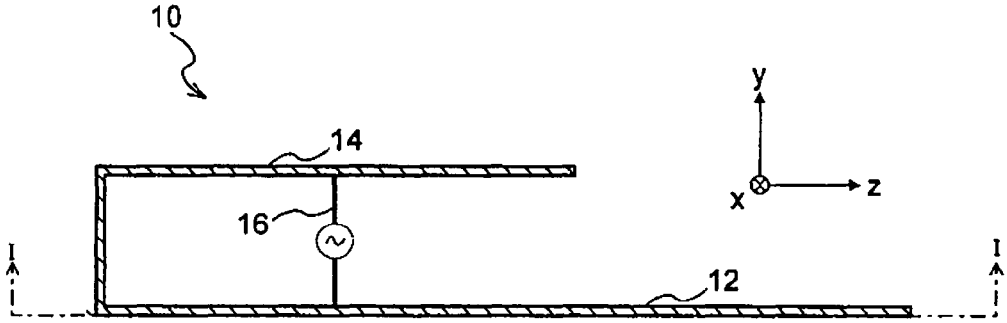
Figure 2:
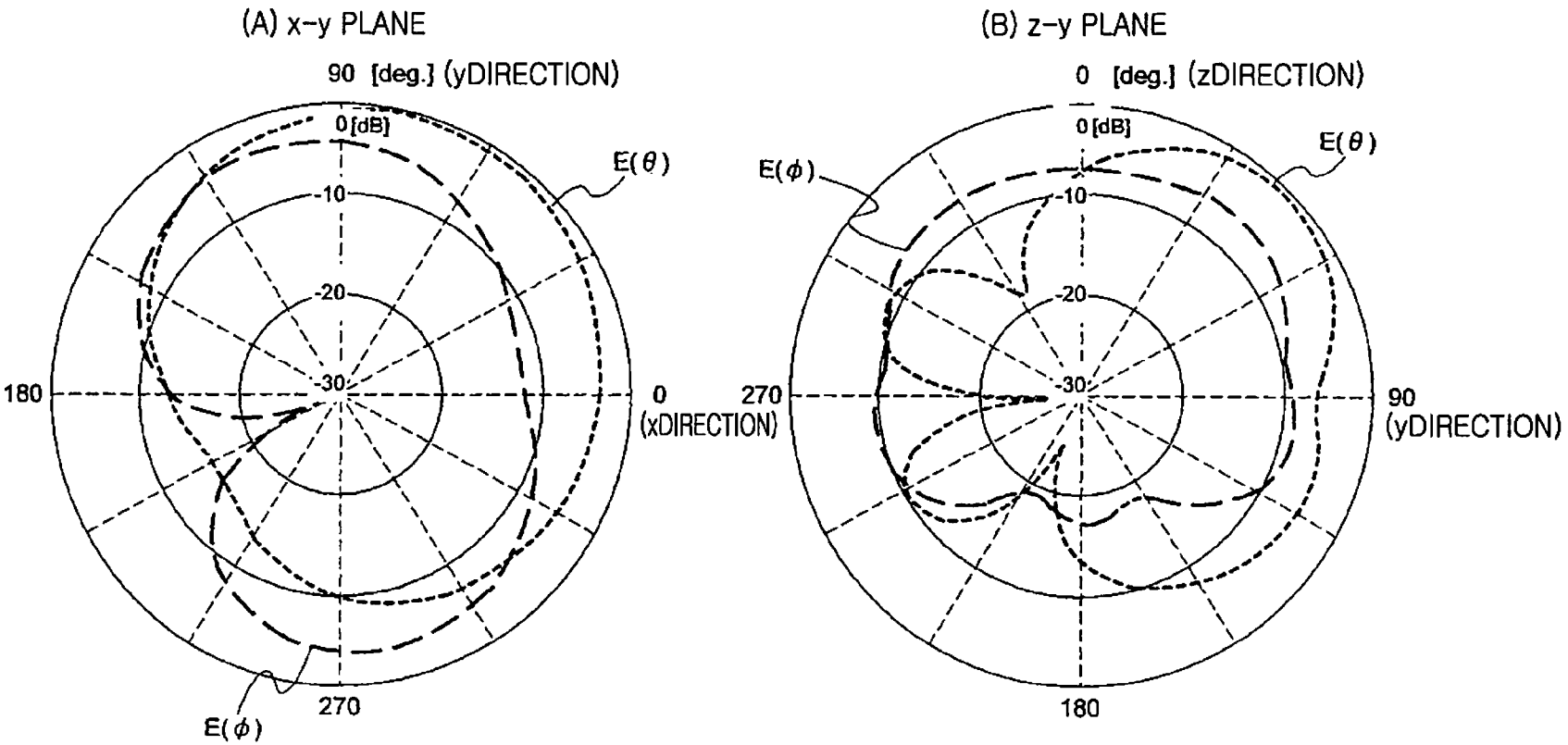
FIGS. 2A and 2B are diagrams illustrating radiation directivity of a plurality of patch antenna.

Prior to the detailed description of an antenna apparatus according to the present invention, the directivity pattern of an antenna apparatus 10 with a plurality of a quarter wavelength ($\lambda/4$) short-circuited patch antennas will be briefly explained with reference to FIGS. 1A, 1B, 2A and 2B. FIGS. 1A and 1B show the structure of the antenna apparatus 10. FIGS. 2A and 2B show the directivity patterns of the antenna apparatus 10.

FIG. 1A is a perspective view illustrating the antenna apparatus 10. FIG. 1B is a cross sectional view taken along the line I-I of the antenna apparatus 10 of FIG. 1, as viewed in the direction of x.

As shown in FIG. 1A, the antenna apparatus 10 generally includes a base 12, two radiation elements 14, and a feed part 16. The radiation elements 14 are, for example, $\lambda/4$ short-circuited patch antennas (or, $\lambda/4$ short-circuited MicroStrip Antennas (MSA)), and function as radiators. The two radiation elements 14 are arranged in the direction of x and are nearly parallel to each other, and each has one end in the direction of x forming an opening portion and the opposite end having a short-circuited portion. In addition, the radiation elements 14 are feed elements connected with the feed part 16.

FIG. 2A is a diagram showing directivity patterns of horizontally polarized waves $E(\phi)$ and vertically polarized waves $E(\theta)$ of the antenna apparatus 10 in the x-y plane.

Referring to FIG. 2A, a directivity pattern of the horizontally polarized waves $E(\phi)$ in the x-y plane has a null region with a deep cut shape in an area near 210 degrees and maximum radiation strength in an area near 120 degrees or in an area near 270 degrees. On the other hand, a directivity pattern of the vertically polarized waves $E(\theta)$ in the x-y plane has maximum radiation strength in an area near 70 degrees. Also, referring to FIG. 2B, a directivity pattern of the horizontally polarized waves $E(\phi)$ in the z-y plane has its maximum radiation strength in an area near 30 degrees and an area near 330 degrees. A directivity pattern of the vertically polarized waves $E(\theta)$ in the z-y plane has its maximum radiation strength in an area near 45 degrees.

The directivity patterns belong to the radiation element 14 on the left side of FIG. 1A. The directivity patterns of the radiation element 14 on the right side of FIG. 1A are mirror images of the directivity patterns in the x-y plane of FIG. 2A with respect to the y-axis. Also, since the left and right radiation elements have the same directivity patterns for the z-y plane, the directivity patterns of the antenna apparatus 10 in the z-y plane have maximum radiation strength in the area near 45 degrees. Therefore, when the user holds a portable terminal in front of him such that the radiation elements 14 faces himself, the antenna apparatus 10 is tilted in the direction of y, whereby radiation peaks are directed toward himself. Therefore, when the radiation peaks in x-y plane go in the direction of y, a part of the radio waves is blocked.

Therefore, the object of this embodiment is to control radiation directivity of a plurality of radiation elements and tilt radiation peaks in a desired direction using one parasitic element. In addition, another object of is this embodiment is to control directivity pattern of two radiation elements using one parasitic element, thereby realizing the miniaturization of the antenna apparatus with a desired directivity. Hereinafter, an antenna apparatus 100 of this embodiment is described in detail.

Hereinafter, an antenna apparatus according to a first embodiment of the present invention will be described. This embodiment provides an antenna apparatus which employs a λ/4 short-circuited patch antenna to form an antenna pattern to permit high-speed communication. Thus, this embodiment includes one driven element which can simultaneously control radiation directivity of two radiation elements and can function as a reflector or a director so as to form a desired antenna pattern.

Figure 3A:
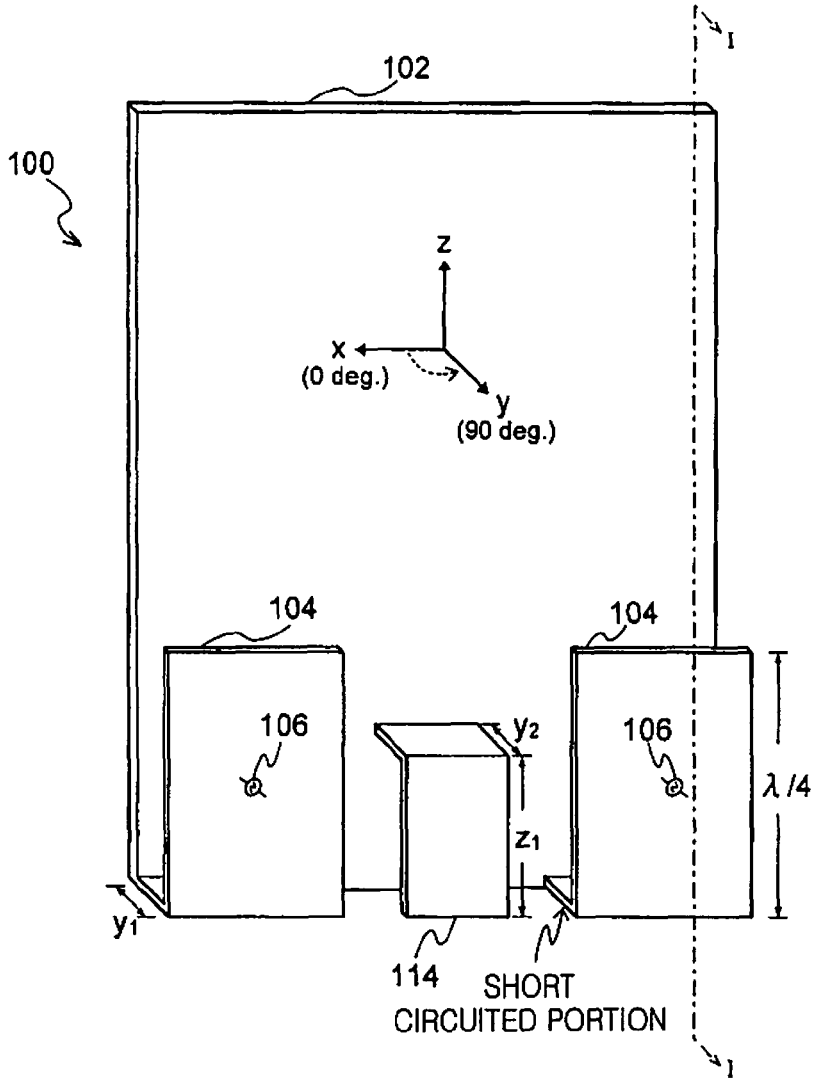
FIGS. 3A and 3B are diagrams illustrating a structure of an antenna apparatus according to a first embodiment of the present invention.
Figure 3B:
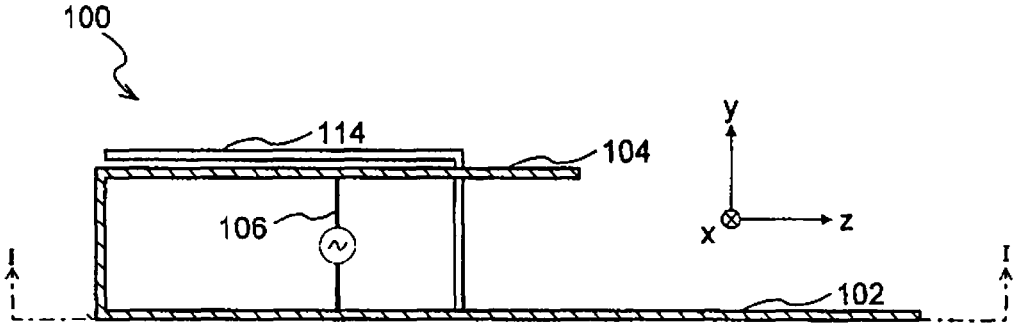

First, one example of a configuration of the antenna apparatus 100 according to this embodiment will be explained with reference to FIGS. 3A and 3B. FIGS. 3A and 3B show the one example of the configuration of the antenna apparatus 100 of this embodiment, in which FIG. 3A is a perspective view illustrating the overall structure of the antenna apparatus 100 and FIG. 3B is a cross sectional view taken along the line I-I of the antenna apparatus 100 of FIG. 3A.

Referring to FIG. 3A, the antenna apparatus 100 includes a base 102, two radiation elements 104, a feed part 106, and a parasitic element 114.

The two radiation elements 104 are arranged in the direction of x and are nearly parallel to each other. The radiation elements 104 are feed elements being supplied power from the feed part 106. Further, each of the radiation elements 104 has a planar plate portion (z-x plane) nearly parallel to the base 102 and a short-circuited portion extending from one end of the planar plate portion so as to be short-circuited to the base 102. Also, each of the radiation elements 104 has, on the opposite side of the short-circuited portion, an opening portion formed by the opposite end thereof spaced apart from the base 102. The two radiation elements 104 are arranged nearly parallel to each other and have the respective opening portions in the direction of z.

The parasitic element 114 is disposed between the two radiation elements 104 arranged in the direction of x. The parasitic element 114 is a driven element. In the example of FIG. 3A, the parasitic element 114 has a length z1 extending in the direction of z. The length z1 of the parasitic element 114 is shorter than the length λ/4 of the radiation elements 104 extending in the direction of z. For this reason, the parasitic element 114 functions as the director, so that it tilts directional peaks of the radiation elements 104 toward the radiation elements 104. For example, the directional peaks of vertically polarized waves radiated from the radiation elements 104 are tilted in the direction of 0 degree without existing in the x-y plane.

Further, like the radiation elements 104, the parasitic element 114 has a planar plate portion (z-x plane) parallel to the base 102 and a short-circuited portion extending from one end of the planar plate portion so as to be short-circuited to the base 102. Also, the parasitic element 114 has, on the opposite side of the short-circuited portion, an opening portion formed by the opposite end thereof spaced apart from the base 102. The opening portion of the parasitic element 114 is in the same direction as those of the short-circuited portions of the radiation elements 104. In the example of FIG. 3B, the parasitic element 114 is illustrated, for clarity, such that the height y2 thereof is higher than the heights y1 of the radiation elements 104. However, the parasitic element 114 of this embodiment can also be either even with or lower than the radiation elements 104.

As described above, the one example of the configuration of the antenna apparatus 100 according to this embodiment, in which the length of the parasitic element 114 is shorter than those of the radiation elements 104, has been explained. With the above configuration, the two radiation elements 104 have radiation directivity in which radiation peaks are tilted in the direction of x in the x-y plane so as to come close to the respective radiation elements 104. For this reason, the radio waves of the radiation elements 104 radiated toward the user have radiation peaks in directions avoiding the user's body, so the ratio of being blocked by the user's body becomes reduced, thereby allowing higher communication sensitivity.

Figure 4A:
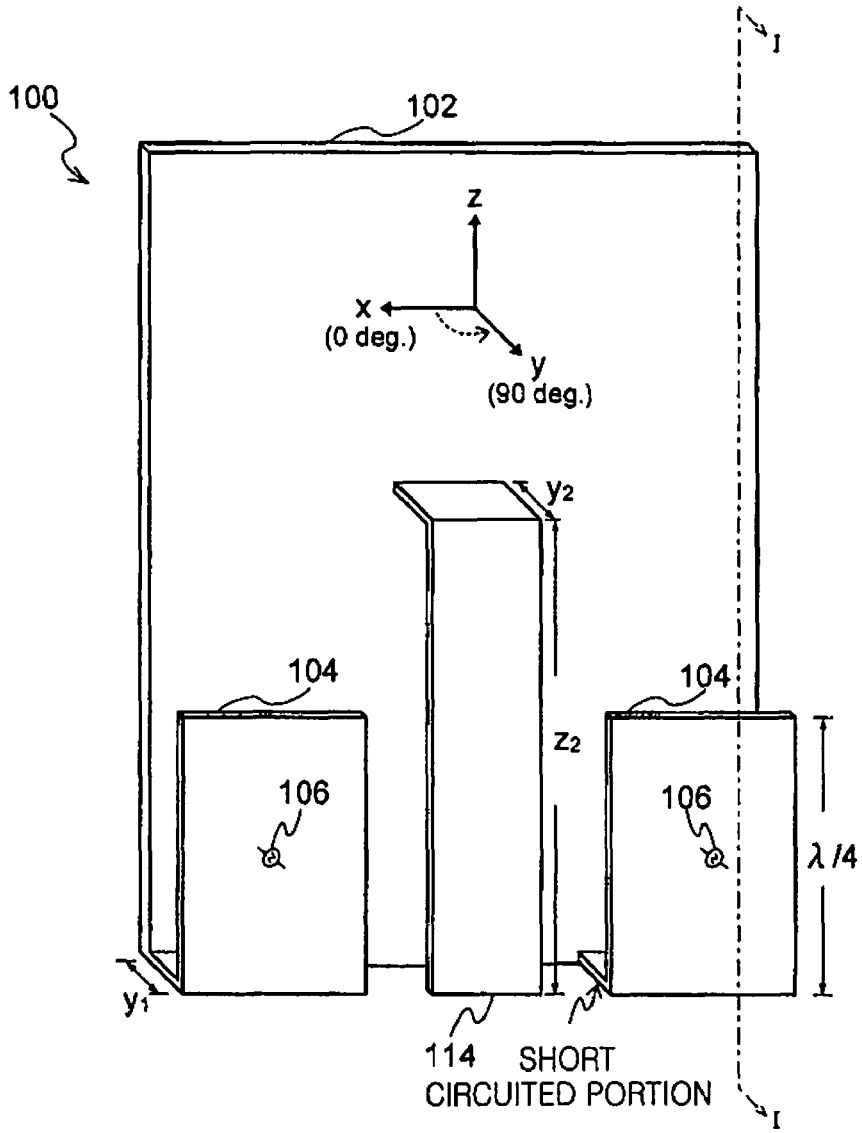
FIGS. 4A and 4B are diagrams illustrating a structure of an antenna apparatus according to the first embodiment of the present invention.
Figure 4B:
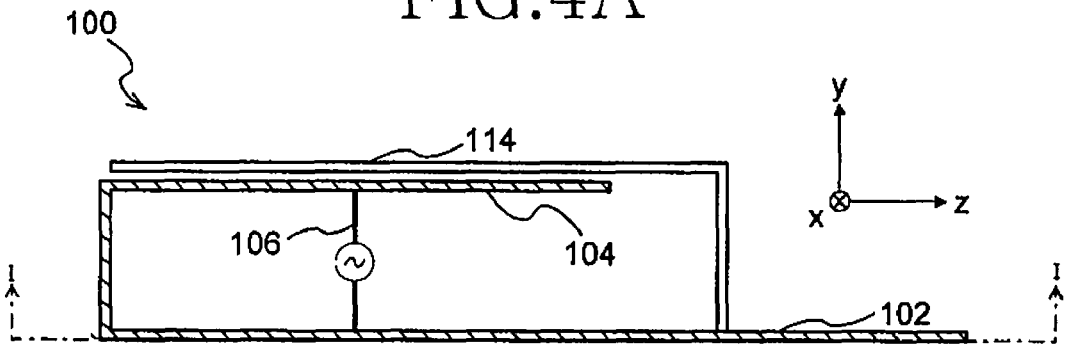

Next, referring to FIGS. 4A and 4B, another example of the configuration of the antenna apparatus 100 according to this embodiment of the present invention will be explained. FIGS. 4A and 4B shows the another example of the configuration of the antenna apparatus 100 according to this embodiment of the present invention, in which FIG. 4A is a perspective view illustrating the overall structure of the antenna apparatus 100 and FIG. 4B is a cross sectional view taken along the line I-I of the antenna apparatus 100 shown in FIG. 4A and viewed in the direction of x-axis. The configuration of the antenna apparatus 100 of FIGS. 4A and 4B is substantially the same as that of the antenna apparatus 100 of FIGS. 3A and 3B, except for a structural characteristic of a parasitic element 114. Therefore, only the difference between them will be explained.

The parasitic element 114 of FIGS. 4A and 4B, like the antenna apparatus 100 of FIGS. 3A and 3B, is disposed between the radiation elements 104 which are arranged in the direction of x and are nearly parallel to each other. The parasitic element 114 is also a driven element. The parasitic element 114 shown in FIG. 4A has a length z2 extending in the direction of z. Further, the length z2 of the parasitic element 114 is longer than the length λ/4 of the radiation elements 104 in the direction of z. For this reason, the parasitic element 114 functions as a reflector, so it tilts the directional peaks of the radiation elements 104 toward the parasitic element 114.

As described above, the main difference between the antenna apparatus 100 of FIGS. 4A and 4B and the antenna apparatus 100 of FIGS. 3A and 3B is in the ratio of the length of the parasitic element 114 thereof to the lengths of the radiation elements 104. According to the difference in this configuration, the tilted directions of the directional peaks of their radiation elements 104 are different, and hence the directivity patterns of the radiation elements 104 can be controlled to be optimized by adjusting the length of the parasitic element 114 according to the location and direction of the antenna apparatus mounted on the portable terminal, etc.

As described above, the another example of the configuration of the antenna apparatus 100 according to this embodiment, in which the length of the parasitic element 114 is longer than those of the radiation elements 104, has been explained. With this configuration, the two radiation elements 104 have radiation directivity in which radiation peaks are tilted in the direction of x in the x-y plane so as to come close to the parasitic element 114.

Figure 5:
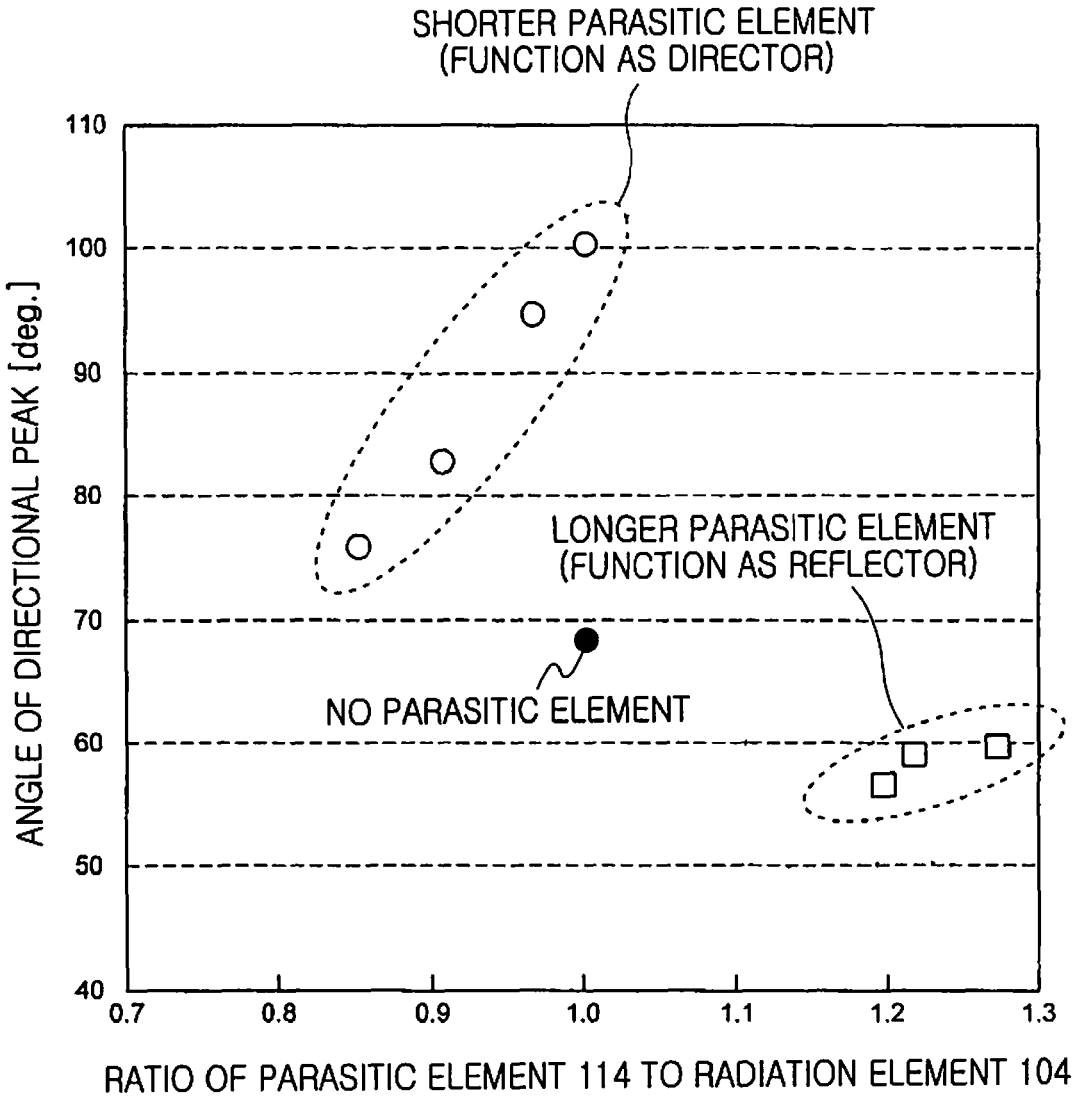
FIG. 5 is a diagram illustrating directional peak angles of the antenna apparatus according to the first embodiment of the present invention.

FIG. 5 shows results of simulation on the examples of the configuration of the antenna apparatus 100. FIG. 5 shows results of simulating the angle variations of the directional peaks depending on the length variations of the parasitic element 114 and radiation elements 104. Especially, FIG. 5 shows directivity characteristic of the radiation element 104 on the left side of FIGS. 3A and 3B or FIGS. 4A and 4B.

In FIG. 5, a result of the simulation in the case where the parasitic element 114 is shorter is indicated by the symbol "○", and a result of the simulation in the case where the parasitic element 114 is longer is indicated by the symbol "□". A result of the simulation in the case where no parasitic element is included is indicated by the symbol "●".

First, the case of the parasitic element 114 being shorter is explained. Referring to FIG. 5, a plurality of "○" are shown in the area where the ratio of the length of the parasitic element 114 to the length of the radiation elements 104 is less than "1". As described above, the parasitic element 114 under this condition functions as the director. Therefore, the angles of the directional peaks in this case show values larger than those of the case where no parasitic element is employed. It can also be appreciated that the shorter the length of the parasitic element 114 is, the smaller the angles of the directional peaks are.

Next, the case of the parasitic element 114 being longer is explained. Referring to FIG. 5, a plurality of "□" are shown in the area where the ratio of the length of the parasitic element 114 to the length of the radiation elements 104 is more than "1". As described above, the parasitic element 114 under this condition functions as the reflector. Therefore, the angles of the directional peaks in this case show values smaller than those of the case where no parasitic element is employed. It can also be appreciated that the angles of the directional peaks become slightly larger when the length of the parasitic element 114 becomes longer.

As described above, it can be also verified in the above results of the simulation that the variation of the directivity depends on the length of the parasitic element 114. Accordingly, by configuring the length of the parasitic element 114 based on the angles of the directional peaks as shown in FIG. 5, for example, portable terminals with better speech quality can be designed.

As described above, the antenna apparatus 100 of this embodiment is characterized in that it controls the directivity patterns of two feed elements by using one driven element (parasitic element 114). This characteristic is an outstanding advantage in that the antenna apparatus can be more miniaturized than the case where directivity patterns of one feed element is controlled by one driven element. Especially, since the size of the antenna apparatus including members related to the control of the directivity is important when high speed communication technologies, such as MIMO using a number of antennas are applied to the small-sized portable terminals, this embodiment is advantageously applied to such devices. For example, the technologies related to this embodiment are expected to be applicable to multiple antennas, APS (Antenna Pattern Selection), AS (Antenna Selection), etc., used in MIMO communication.

An antenna apparatus 200 according to a second embodiment of the present invention is explained below. A detailed description of components which are substantially the same as those of the antenna apparatus 100 of the first embodiment will be omitted by using identical reference numerals.

Figure 6A:
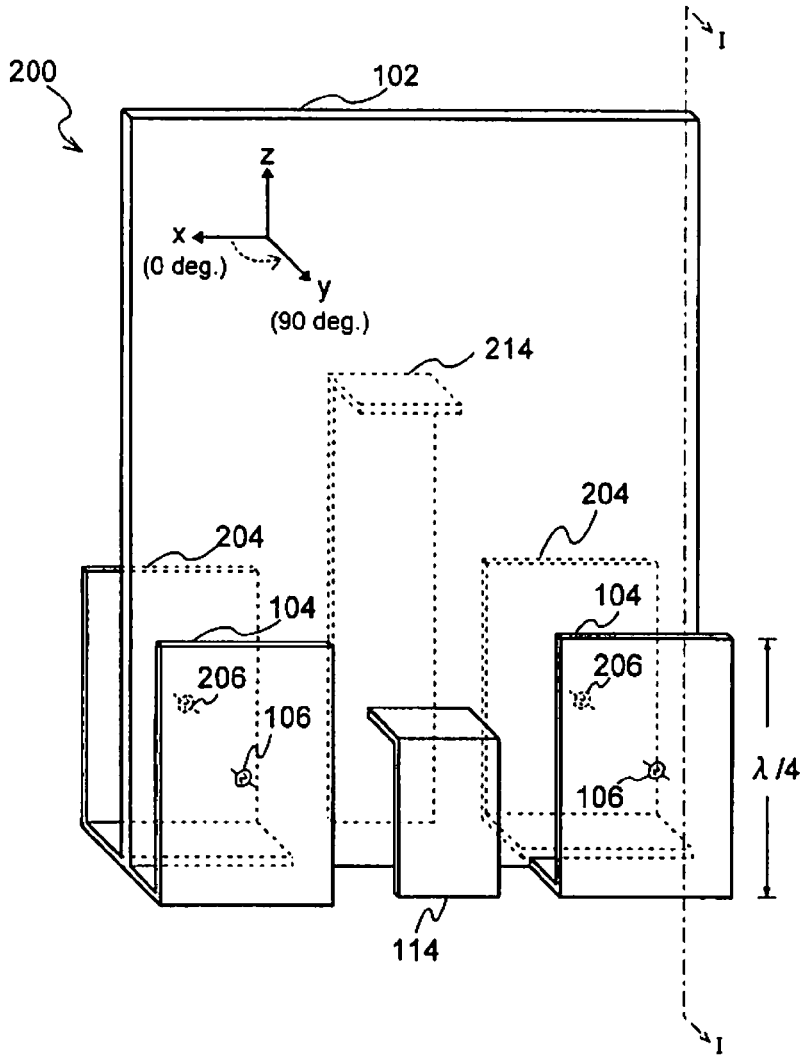
FIGS. 6A and 6B are diagrams illustrating a structure of an antenna apparatus according to a second embodiment of the present invention.
Figure 6B:
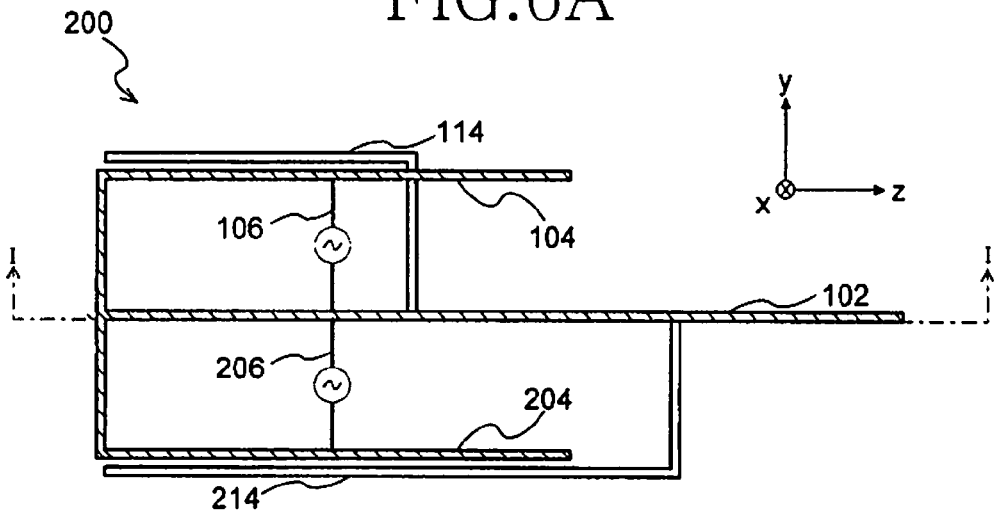

First, a configuration the antenna apparatus 200 of this embodiment will be explained with reference to FIGS. 6A and 6B. FIGS. 6A and 6B show the antenna apparatus 200 of this embodiment, in which FIG. 6A is a perspective view illustrating the overall structure of the antenna apparatus 200 and FIG. 6B is a cross sectional view taken along the line I-I of the antenna apparatus 200 shown in FIG. 6A and viewed in the direction of x.

As shown in FIGS. 6A and 6B, the antenna apparatus 200 includes a base 102, a plurality of radiation elements 104 and 204, a plurality of feed parts 106 and 206, and a plurality of parasitic elements 114 and 214. As shown in FIGS. 6A and 6B, in the antenna apparatus 200, the components of the antenna apparatus 100 shown in FIGS. 3A, 3B, 4A and 4B are disposed in both faces thereof.

In a first face (a surface) of the base 102, there are two radiation elements 104 and a parasitic element 114 disposed between the two radiation elements 104. The base 102 has, in a second face (the opposite surface) thereof, two radiation elements 204 and a parasitic element 214 disposed between the radiation elements 204. The parasitic element 114 has a length which extends in the direction of z and is shorter than those of the radiation elements 104. Also, the parasitic element 214 has a length which extends in the direction of z and is longer than those of the radiation elements 104.

Figure 7:
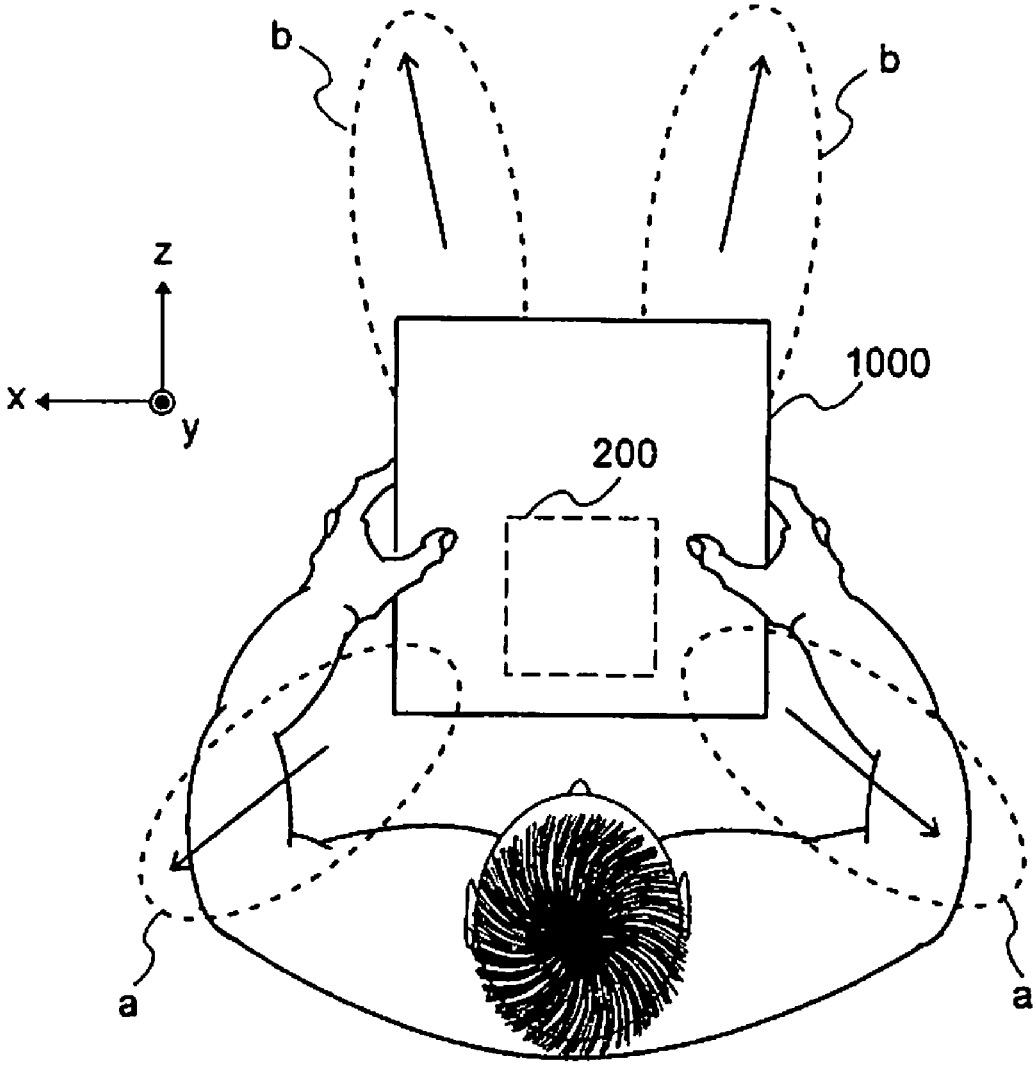
FIG. 7 is a view illustrating effects of the antenna apparatus according to the second embodiment of the present invention.

Therefore, as described in the description of the first embodiment, the parasitic element 114 in the first face of the base 102 functions as a director, and the parasitic element 214 in the opposite face of the base 102 functions as a reflector. For this reason, when the user holds a portable terminal 1000 mounting the antenna apparatus 200 in a way that the direction of y is positioned in front of him as shown in FIG. 7, the portable terminal 1000 mounting the antenna apparatus 200 of this embodiment has optimal directivity including directional peaks of directions avoiding the user's body and directional peaks of forward directions. Of course, by mounting the antennas in the both sides, this embodiment can provide an effect that can deal with radio waves received from the back side of the portable terminal 1000.

Like this example, a radiation pattern can be configured to avoid the head of the user in the user side and a radiation pattern can be configured to be directed toward the upper front rather than toward the ground in the opposite side. Although FIGS. 6A and 6B illustrate a configuration for a MIMO system which uses four radiation elements independently, a two-element MIMO antenna for APS can be configured by performing feed control of two radiation elements disposed in both sides as a single antenna unit and converting one radiation element to be practically used as an antenna with a switch.

In the above embodiments, the specific configurations of the antenna apparatus have been explained. These antenna apparatuses can be advantageously mounted to wireless communication terminals capable of high-speed transmission, such as a MIMO terminal. For example, this wireless communication terminal has, in a transmitting side, a series-parallel converting means of input signals and a modulation mapping means of the converted signals, and transmits a plurality of modulated and mapped signals via a plurality of radiation elements provided to the antenna.

Meanwhile, this wireless communication terminal uses, in a receiving side, a means of receiving a plurality of received signal via a plurality of radiation elements and restoring a plurality of original modulated signals from a plurality of received signals by using a channel matrix, a means of demodulating a plurality of modulated signals, and a parallel-series converting means so as to estimate the original signals. Of course, the wireless communication terminal may also include a means of encoding/decoding data, a means of estimating the channel matrix, means of pre-coding transmitting signal, or a means of estimating possibility.

According to the present invention as described above, the directivity of radiation elements can be controlled by a using relatively simple structure.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna apparatus comprising:

a base having a first face and a second face;

two radiation elements arranged parallel to each other on the first face of the base; and a parasitic element disposed between the two radiation elements on the first face of the base, wherein radiation directivity of the two radiation elements is controlled according to a length of the parasitic element, wherein the parasitic element, which is shorter than the radiation elements, functions as a director and tilts directional peaks toward the radiation elements, wherein the radiation elements and the parasitic element respectively include a planar plate portion substantially parallel to the base, a short-circuited plate portion extending from one end of the planar plate portion to be short-circuited to the base, and an opening portion formed by an opposite end of the planar plate portion spaced apart from the base, wherein each of the opening portions of the two radiation elements is opened in a predetermined first direction, and the opening portion of the parasitic element is opened in a direction opposite of the direction, wherein the radiation elements are supplied power and the parasitic element is not supplied power, and wherein short-circuited plate portions of the radiation elements are positioned at one end of the base and a short-circuited plate portion of the parasitic element is positioned apart from the one end of the base.

2. The antenna apparatus as claimed in claim 1, wherein the parasitic element is formed of a quarter wavelength (λ/4) short-circuited patch antenna.

3. The antenna apparatus as claimed in claim 1, wherein each of the lengths of the parasitic element and the radiation elements is a length extended in the first direction and defined between the short-circuited portion thereof and the opening portion thereof.

4. The antenna apparatus as claimed in claim 1, wherein an air layer is disposed directly between the planar plate portion and the base.

5. An antenna apparatus comprising:

a base having a first face and a second face;

two planner radiation elements arranged parallel to each other on the first face of the base;

a planar parasitic element disposed between the two planar radiation elements on the first face of the base;

two additional radiation elements arranged on the second face of the base and parallel to each other;

an additional parasitic element disposed between the two additional radiation elements, wherein radiation directivity of the two radiation elements is controlled according to a length of the parasitic element, and wherein the antenna apparatus further comprises a feed part adapted to perform feed-controlling of the radiation elements and the additional radiation elements so as to be synchronized to transmit/receive modulated signals of multiple-input multiple-output modulated system.

6. The antenna apparatus as claimed in claim 5, wherein the additional parasitic element, when longer than the additional radiation elements, functions as a reflector and tilts directional peaks toward the additional radiation element.

7. The antenna apparatus as claimed in claim 5, wherein the additional radiation elements are each formed of a quarter wavelength (λ/4) short-circuited patch antenna.

8. The antenna apparatus as claimed in claim 5, wherein each of the lengths of the additional parasitic element and the additional radiation elements is a length extended in the first direction and defined between the short-circuited portion thereof and the opening portion thereof.

9. The antenna apparatus as claimed in claim 5, wherein the parasitic element is formed to be longer than the radiation elements, and the additional parasitic element is formed to be shorter than the additional radiation elements.

10. The antenna apparatus as claimed in claim 5, wherein the lengths of the radiation elements and the lengths of the additional radiation elements are substantially the same as each other, and the length of the parasitic element and the length of the additional parasitic element are different from each other.

11. A wireless communication terminal comprising an antenna apparatus having a base with a first face and a second face, two radiation elements arranged parallel to each other on the first face of the base, and a parasitic element disposed between the two radiation elements on the first face of the base, wherein radiation directivity of the two radiation elements is controlled according to a length of the parasitic element, and wherein the parasitic element, which is longer than the radiation elements, functions as a reflector and tilts directional peaks toward the parasitic elements, wherein the radiation elements and the parasitic element respectively include a planar plate portion substantially parallel to the base, a short-circuited portion extending from one end of the planar plate portion to be short-circuited to the base, and an opening portion formed by an opposite end of the planar plate portion spaced apart from the base, wherein each of the opening portions of the two radiation elements is opened in a predetermined first direction, and the opening portion of the parasitic element is opened in a direction opposite of the first direction, and wherein the radiation elements are supplied power and the parasitic element is not supplied power.

* * * * *